United States Patent [19]

Melcher et al.

[11] 4,283,045

[45] Aug. 11, 1981

[54] APPARATUS FOR THE CONTINUOUS RECOVERY OF TIN FROM IRON RICH CONCENTRATES

[75] Inventors: Gerhard Melcher; Horst Weigel, both of Cologne, Fed. Rep. of Germany

[73] Assignee: Klöckner-Humboldt-Deutz AG, Fed. Rep. of Germany

[21] Appl. No.: 115,752

[22] Filed: Jan. 28, 1980

Related U.S. Application Data

[62] Division of Ser. No. 952,963, Oct. 20, 1978, Pat. No. 4,236,916.

[30] Foreign Application Priority Data

Oct. 24, 1977 [DE] Fed. Rep. of Germany ..... 2747586

[51] Int. Cl.[3] ..... C22B 9/00

[52] U.S. Cl. ..... 266/162; 266/172

[58] Field of Search ..... 266/172, 162; 75/26, 75/72

[56] References Cited

U.S. PATENT DOCUMENTS

| | | | |
|---|---|---|---|
| 3,555,164 | 1/1971 | Kostin et al. | 75/10 R |
| 3,902,895 | 9/1975 | Wuth | 75/72 |
| 4,017,307 | 4/1977 | Winterhager et al. | 75/26 |

*Primary Examiner*—M. J. Andrews

*Attorney, Agent, or Firm*—Hill, Van Santen, Steadman, Chiara & Simpson

[57] ABSTRACT

A method and apparatus for the continuous recovery of tin of low iron content from an iron rich concentrate wherein the concentrate is smelted in suspension in an atmosphere ranging from neutral to weakly reducing to produce a smelt containing tin and iron silicates, the smelt is reduced with a gaseous reduction agent under conditions of high velocity jet treatment, the reduction being at a suitable reaction temperature and with a reduction potential of reducing gas so as to substantially prevent the reduction of the iron silicate to metallic iron.

6 Claims, 6 Drawing Figures

APPARATUS FOR THE CONTINUOUS RECOVERY OF TIN FROM IRON RICH CONCENTRATES

This is a division, of application Ser. No. 952,963, filed Oct. 20, 1978, now U.S. Pat. No. 4,236,916.

BACKGROUND OF THE INVENTION

1. Field of the Invention

The present invention relates to the recovery of tin from iron containing tin concentrates through the utilization of a suspension smelting reaction, and a high velocity gas reduction reaction carried out continuously.

2. Description of the Prior Art

Tin has been considered one of the more precious metals and has been recovered for 5000 years at relatively low temperatures from cassiterite ores in the presence of coal or carbon. In later times, however, it was necessary to use ore deposits which were less abundant in tin and more abundant in iron, making it necessary that the smelting be carried out in multistage processes, thereby substantially increasing the costs. At first, the smelting of such complex ores containing higher iron contents was considered economically not feasible, per se, so these ores were merely mixed with ores low in iron and rich in tin, and subsequently smelted.

With the development of wet metallurgy processes, new ways were found for the concentration of tin in the ore as well as for the separation of foreign metals. However, these methods although quite practical, have the disadvantage that they are relatively high in cost.

With the development of the volatilization method which today corresponds with the state of the art, it was possible to efficiently smelt complex, tin bearing ores. The process became economically of interest when it was found that the addition of pyrite, a tin sulfide, could be volatilized easily with relatively high stream pressures and this tin sulfide could be converted through combustion in the gas phase to tin oxide which after sublimation could be precipitated in the solid phase. One disadvantage, however, was the necessity of using a series of process steps which were expensive, used high amounts of energy, and provided some environmental problems.

SUMMARY OF THE INVENTION

The present invention makes available a method as well as an apparatus for the recovery of metallic tin from complex, iron containing ores which provides for smelting of these ores as economically as possible. The process is carried out in a small number of process steps so that it is relatively uncomplicated and thereby reduces the expenditure of energy without spoiling the environment. A product is produced which is as low in iron as possible and slag is produced with a very low content of precious metals, particularly tin.

In accordance with the present invention, the concentrate is smelted in an atmosphere which may range from neutral to a weakly reducing atmosphere to produce a smelt containing a mixture of metal silicates, including tin and iron silicates. This smelt is then reduced with a gaseous reduction agent in a single stage, carried out at such a reduction temperature and with such a reduction potential of the reaction gas so that a simultaneous reduction of iron silicate to iron is substantially prevented thermodynamically.

In a preferred form of the present invention, the reduction is carried out at a temperature above the Boudouard equilibrium. The reaction gas preferably consists of a mixture of carbon dioxide and carbon monoxide. The reduction gas may, however, also contain a mixture of hydrocarbons with carbon dioxide.

In the preferred form of the present invention, the reduction gas at a reduction temperature of 1100° C. has a reduction potential, log ($pCO_2/pCO$) within the range of +0.6 to −0.1, corresponding to about 80% carbon dioxide—20% carbon monoxide to 44% carbon dioxide—56% carbon monoxide. The reduction gas at a reduction temperature of about 1300° C. has a reduction potential in the range between +0.65 to −0.2 corresponding to about 82% carbon dioxide—18% carbon monoxide to 39% carbon dioxide—61% carbon monoxide. In the most preferred embodiment of the invention, in the interval of reduction temperatures of about 1100° to about 1300° C., the reduction potential of the gas mixture is approximately 0.35 which corresponds to a mixture containing approximately 70% carbon dioxide and 30% carbon monoxide.

One of the advantages of the method according to the present invention is that it is suitable for continuous operation. To this end, the smelting process at the beginning of the procedure is carried out continuously, preferably in the suspension smelting method in which the concentrate is suspended in the gas. In order to prevent high concentrations of oxygen in the smelt, the smelting process is carried out with a flaming gas containing stoichiometric or slightly less than stoichiometric amounts of fuel for combustion with an oxygen containing, heated gas.

In order to prevent release of undesirable amounts of metallic iron into the liquid tin metal, the reduction is carried out while maintaining as short as possible the contact period between the metal and the slag. To achieve this, the heavier phase of the smelt which is enriched with a liquid metal and the lighter slag are conveyed layerwise in counter-current contact with each other through the reaction chamber.

For adjusting and maintaining a continuous reaction, the material current densities of the solid and/or the liquid and/or the gaseous phases are held approximately constant. Advantageously, to accomplish this result we may introduce an uninterrupted flow of fresh reduction gas to the interface of the phases by means of a confined stream which is directed at the interface with the highest possible kinetic energy so as to prevent spattering of the molten bath. To accomplish rapid sedimentation of the metal droplets forming and/or formed in the metal bath, an intensive spatial convective movement of the smelt and/or the slag is carried out.

The reducing gas is preferably blown by means of a plurality of blowing streams or jets onto the smelt, whereby the smelt flows with approximately constant velocity in the longitudinal direction of the reaction chamber and thereby moves through the jets in the direction of slag discharge. In order to make the kinetic reaction system as effective as possible in the area of the liquid and gaseous phases, the depth of the bath of the smelt decreases in the direction of flow of the slag.

In order to provide for the advance of the reduction gas with the highest possible energy potential, a blower type high speed jet is utilized. In a preferred form of the invention, the reducing gas leaving the nozzle has a speed in the range of about Mach 1 to 3.

The apparatus according to the present invention includes a reactor having a furnace well as well as a device for smelting a suspension of the concentrate in the area of the material inlet. On the opposite side of the reaction chamber there is an overflow weir for the runoff of slag. The depth of the tank increases from the slag runoff toward the smelting device and in the vicinity of the smelting device there is a runoff for liquid metal, which level is below the overflow weir of the slag. There is also a wall projecting into the molten bath to serve as a deflector in the area of the deepest part of the chamber. Finally, there is a system of blower lances projecting into the gas chamber of the reactor for introducing the reaction gas. It is preferable that the area in which the material is charged into the reactor by provided with a gas withdrawal means. At the opposite end of the reactor, there is an aperture for the introduction or removal of gas. Finally, the apparatus may be suitably formed so that the reaction area beneath the smelting device is separated from the other portion of the reaction chamber by means of a partitioning wall.

The blower lances are preferably arranged in longitudinal spaced relationship with approximately equal spacing along the reactor. These lances may be equipped with cooling devices for the circulation of water, for example, as well as for an exit nozzle in the nature of a Laval nozzle or a similar nozzle device.

DESCRIPTION OF THE PREFERRED EMBODIMENTS

According to the present state of the art, as previously noted, the recovery of tin present as an oxide takes place by means of smelting the oxide in the form of a concentrate in a revolving reverberatory furnace, a stationary hearth type furnace or an electrical furnace under reducing conditions. The reducing medium almost invariably consists of solid coal which must be low in ash and volatile constituents. The reduction reaction proceeds in the following overall equation:

$$2SnO_2+3C=2Sn+2CO+CO_2 \quad \text{(I)}$$

Thermodynamically, the chemical equilibrium of the overall reaction can be expressed as follows:

$$\log K_{(I)} = \log \frac{a^2Sn_{(l)} \cdot p^2CO_{(g)} \cdot pCO_{2(g)}}{a^2SnO_{2(s)} \cdot a^3C_{(s)}} \quad (1)$$

Where a is the activity of the liquid and solid reaction participants, p is the partial pressure of the gaseous reactant, s refers to a solid, l refers to a liquid, and g refers to a gas.

Since the equilibrium may be expressed in terms of the gaseous reaction participants, the equilibrium equation can be also represented as the ratio of the gaseous participants as follows:

$$\log \frac{p\,CO_2}{p\,CO} = 1.5 \log p\,CO_2 - 0.5 \log k_{(II)} \quad (2)$$

If the concentrate also contains a substantial iron content, the iron oxide reacts during reducing conditions with solid coal according to the overall equation:

$$2Fe_2O_{3(s)}+4.5C_{(s)}=4Fe_{(l)}+3CO_{(g)}+1.5CO_{2(g)} \quad \text{(II)}$$

As solid $Fe_2O_3$ and C as well as liquid iron do not mix with each other, the following equilibrium reaction exists:

$$\log \frac{p\,CO_2}{p\,CO} = 1.5 \log p\,CO_2 - 0.35 \log K_{(II)} \quad (3)$$

In the equilibrium conditions (2) and (3) of the overall equations (I) and (II), the influence of the solid reduction coal taken into consideration by means of the Boudouard reaction, and represent the actual conditions in the smelting assembly.

The foregoing overall equations, however, can also be split up into the following partial reactions:

$$SnO_{2(s)}+2CO_{(g)} \rightleftharpoons Sn_{(l)}+2CO_{2(g)} \quad \text{(III)}$$

$$FeO_{(s)}+CO_{(g)} \rightleftharpoons Fe_{(l)}+CO_{2(g)} \quad \text{(IV)}$$

$$C_{(s)}+CO_{2(g)} \rightleftharpoons 2CO_{(g)} \quad \text{(V)}$$

Equation (V) is known as the "Boudouard reaction".

Figure 1:
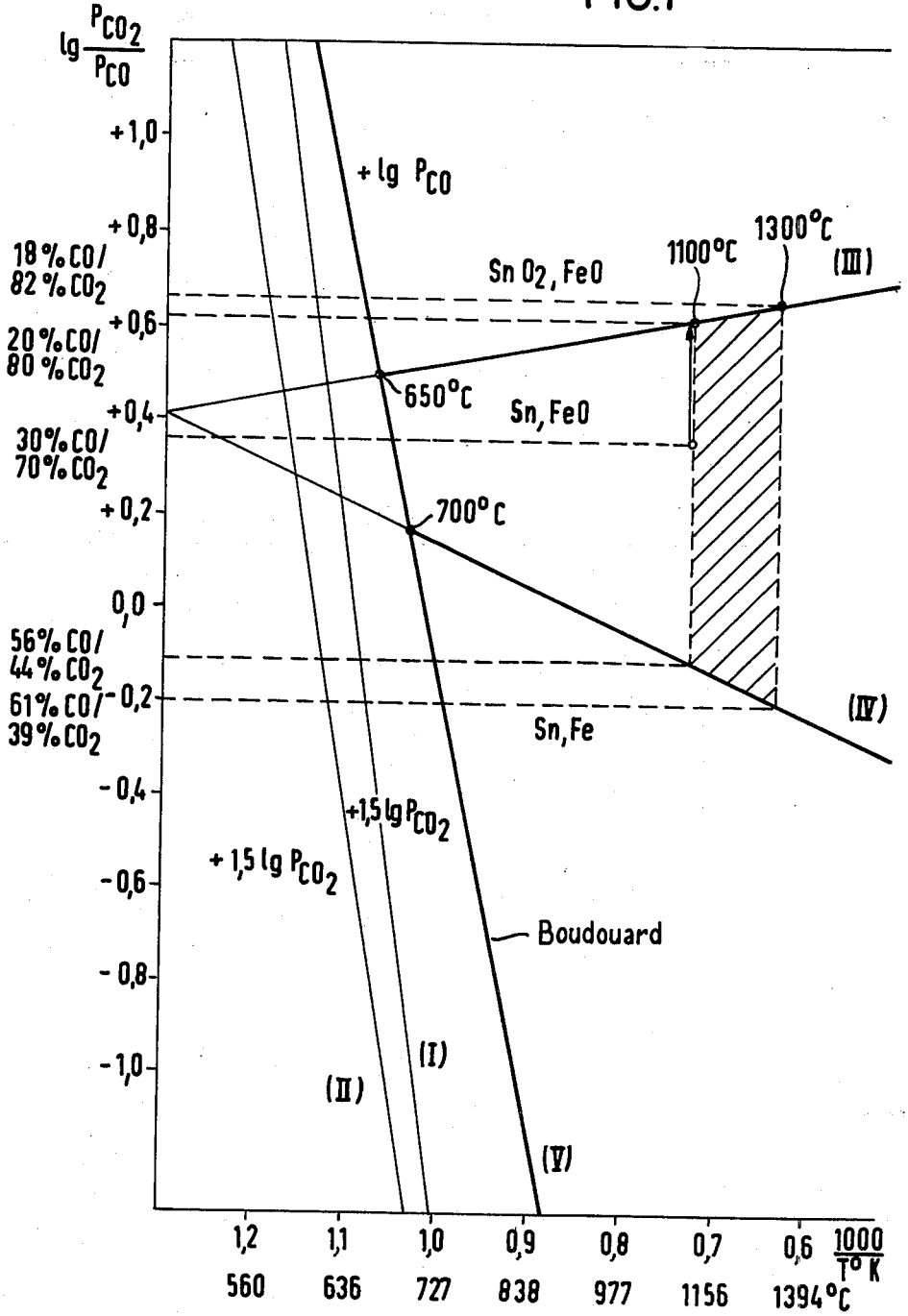
FIG. 1 is a phase diagram showing the various phases of $Sn/SnO_2/Fe/FeO$ for various reduction potential.

In FIG. 1 there is illustrated the areas of existence of the oxidic and metallic phases of tin and iron corresponding to the equilibrium of reactions (III) and (IV) at a $CO_2/CO$ atmosphere. The line of equilibrium with the Boudouard reaction (V) shows from which temperature on a reduction may be accomplished according to reactions (III) and (IV). The phase diagram of FIG. 1 with the lines of equilibrium of the reactions ((III), (IV) and (V) theoretically establish that a $CO_2/CO$ gas mixture with a definite reduction potential can be used to produce metallic tin from the oxide, while the iron remains in oxidic form.

Upon attaining the condition of equilibrium, the gas in the reducing mixture, for example at 1373° K. has the composition:

From equation (III): $CO_2=80\%$; $CO=10\%$.

From the equation (IV): $CO_2=44\%$; $CO=56\%$.

In terms of mol conversion, this means that theoretically an 80% reduction of the tin oxide will occur with a simultaneous co-reduction of iron to 44% if the reduction is commenced with 100% CO gas with stable mixing. Theoretically, if one were to utilize a reduction gas consisting of 30% CO and 70% $CO_2$, then the conversion of the reactions (III) and (IV) at 1373 K would proceed to a condition of equilibrium of the reaction participant. This means that at a temperature of 1373°

K. and the corresponding reduction potential log p $CO_2$/p CO a reduction of the tin oxide is possible, but not a reduction of the iron oxide.

Accordingly, from a solid or stable mixture with a reduction gas whose reduction potential varies within the field characterized by the lines of equilibrium (III) and (IV) and whose temperature is above the Boudouard equilibrium characterized by the line (V), tin oxide could be reduced to tin metal without a co-reduction of the iron taking place. The present invention makes use of this factor to achieve improved reduction capability.

The phase borderlines (I) and (II) present the separating lines of the area of tin dioxide and ferrous oxide in the presence of solid coal. These two lines of equilibrium to the left of the Boudouard equilibrium line (V) establish that in the presence of a solid reduction material such as coal and at temperature ranges to the right of the Boudouard line, in addition to the reduction of tin oxide, there is also a reduction of iron oxide taking place. Carbon dioxide formed is reduced spontaneously to carbon monoxide, whereby the gas atmosphere is shifted into the range below the equilibrium line (IV). This leads to the conclusion that a selective reduction of tin oxide in the presence of solid reducing means such as coal cannot be carried out.

In practice it has been found that in convention smelting furnaces with the available temperatures and the technically available durations, the chemical equilibrium does not occur, so that the conversion according to the reactions (III) and (IV) does not take place quantitatively. Apparently, the oxides not reduced to metal react in the smelt with the silica present in the charge to form silicates. According to Wright's "Extractive Metallurgy of Tin" (Elsevier, London, 1968, pages 18 to 85) the silicate formation can be expressed by the following equations:

$$Sn_{(l)}+0.5O_{2(g)}+SiO_{2(s)} \rightleftarrows SnSiO_{3(l)} \quad \text{(VI)}$$

$$Fe_{(l)}+0.5O_{2(g)}+SiO_{2(s)} \rightleftarrows FeSiO_{3(l)} \quad \text{(VII)}$$

If there two silicate solutions are in equilibrium with each other, then the following equilibrium constants are obtained:

$$SnSiO_{3(l)}+Fe_{(l)} \rightleftarrows Sn_{(l)}+FeSiO_{3(l)} \quad \text{(VIII)}$$

$$K_{(VIII)} = \frac{(Fe\ SiO_3)}{(Sn\ SiO_3)} \cdot \frac{(Sn)}{(Fe)} \quad \text{(4a)}$$

Expressed in another way:

$$\frac{(Fe)}{(Sn)} = \frac{1}{K_{(VIII)}} \cdot \frac{(Fe\ SiO_3)}{(Sn\ SiO_3)} \quad \text{(4b)}$$

Starting with these equations, it will be recognized that the liquid tin metal in contact with an iron-silicate solution in the condition of equilibrium according to equation (VIII) will always dissolve metallic iron and will do so in proportion to the amount of iron silicate in the slag.

Accordingly, an increased iron content must always be present in the raw tin upon smelting from an iron containing tin concentrate when the reduction takes place with a solid reaction medium such as coal and the iron silicate type slag is in equilibrium with the tin metal. For a better understanding of the possible reactions of tin and iron silicate type solutions in the presence of reduction gases, the following equations are submitted:

$$SnSiO_{3(l)}+CO_{(g)} \rightleftarrows Sn_{(l)}+CO_{2(g)}+SiO_{2(s)} \quad \text{(IX)}$$

$$FeSiO_{3(l)}+CO_{(g)} \rightleftarrows Fe_{(l)}+CO_{2(g)}+SiO_{2(s)} \quad \text{X}$$

$$K_{(IX)} = \frac{a\ Sn_{(l)} \cdot pCO_{2(g)} \cdot a\ SiO_{2(s)}}{a\ SnSiO_{3(l)} \cdot pCO_{(g)}} \quad \text{(5)}$$

$$K_{(X)} = \frac{a\ Fe_{(l)} \cdot pCO_{2(g)} \cdot a\ SiO_{2(s)}}{a\ FeSiO_{3(l)} \cdot pCO_{(g)}} \quad \text{(6)}$$

If the activities of the formed tin metal and iron are assumed to be unity, then the equilibrium equations read:

$$K_{(IX)} = \frac{pCO_{2(g)} \cdot a\ SiO_{2(s)}}{a\ SnSiO_{3(l)} \cdot pCO_{(g)}} \quad \text{(7)}$$

$$K_{(X)} = \frac{pCO_{2(g)} \cdot a\ SiO_{2(s)}}{a\ FeSiO_{3(l)} \cdot pCO_{(g)}} \quad \text{(8)}$$

Expressed by means of the ratio of partial pressures of the gaseous reaction participants, the equations become:

$$\log \frac{pCO_2}{pCO} = \log \frac{K_{(IX)} \cdot a\ SnSiO_{3(l)}}{a\ SiO_{2(s)}} \quad \text{(9)}$$

$$\log \frac{pCO_2}{pCO} = \log \frac{K_{(X)} \cdot a\ FeSiO_{3(l)}}{a\ SiO_{2(s)}} \quad \text{(10)}$$

The equilibrium relationships of the reduction reactions (IX) and (X) in a $CO_2$/CO atmosphere then become:

$$\log \frac{pCO_2}{pCO} = \log K_{(IX)} \cdot a\ SnSiO_{3(l)} \quad \text{(11)}$$

$$\log \frac{pCO_2}{pCO} = \log K_{(X)} \cdot a\ FeSiO_{3(l)} \quad \text{(12)}$$

The activities of the silicate type solutions can be expressed as follows:

$$aSnSiO_{3(l)} = NSnO.\gamma SnO \quad \text{(13)}$$

$$aFeSiO_{3(l)} = NFeO.\gamma FeO \quad \text{(14)}$$

Where "N" is the mol breakdown and ($\gamma$) represent the coefficients of activity of the metal oxides in the silicate solution.

Greatly simplified for purposes of practice, an ideal solution may be assumed for the coefficients of activity. Then the equations (IX) and (X) result in the following expressions:

$$\log \frac{pCO_2}{pCO} = \log K_{(IX)} \cdot N_{SnO} \quad \text{(15)}$$

$$\log \frac{pCO_2}{pCO} = \log K_{(X)} \cdot N_{FeO} \quad \text{(16)}$$

Figure 2:
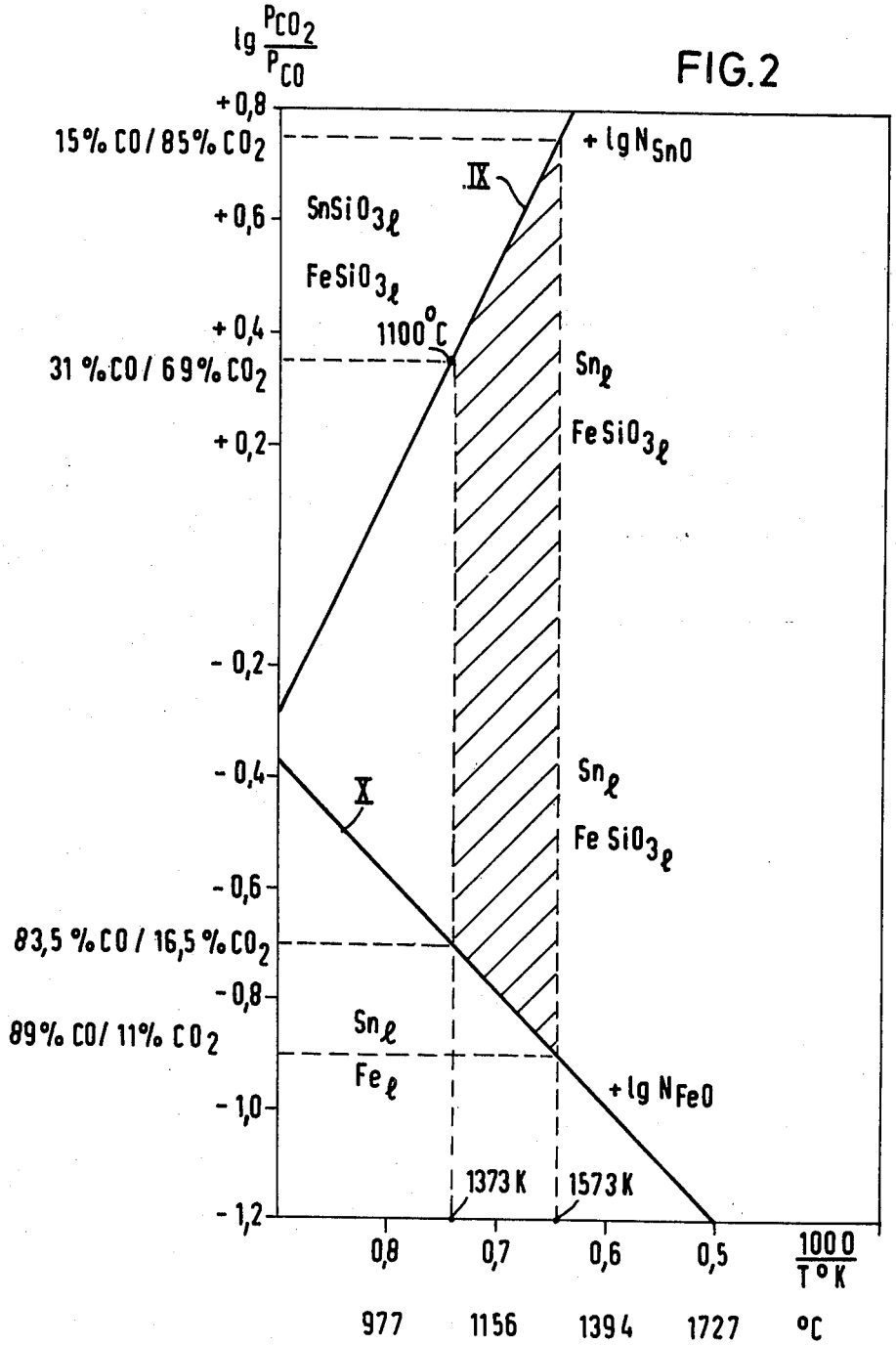
FIG. 2 is a phase diagram for $Sn/SnSiO_3/Fe/FeSiO_3$ in relation to the reduction potential.

FIG. 2 illustrates the ranges of existence of the metallic and silicate type solutions as a function of the temperature and the mol breakdown of the metal oxides in the silicate solutions in a $CO_2$/CO atmosphere. It was found as indicated by the shaded temperature area between 1373° K. and 1573° K. that the production of a raw tin low in iron from a tin-iron-silicate type solution is possible if a gaseous reduction medium is employed at predetermined temperatures and with a predetermined reduction potential in the reduction gas.

The foregoing considerations led to the conclusion that optimal results can be obtained in obtaining a tin metal low in iron from an iron rich ore concentrate with a slag relatively low in tin if:

1. The reduction of the tin from the liquid slag takes place solely with a gas reducing agent and with a temperature whose reduction potential prevents thermodynamically a co-reduction of the iron silicate.

2. The droplets of tin metal formed must be conveyed off as quickly as possible from the smelt so that an equilibrium with iron silicate according to equation (VIII) cannot be maintained.

In contrast to the state of the art wherein smelting is carried out on essentially a batch basis, in the case of the present invention, the reaction-kinetic equilibrium conditions are maintained strictly constant over the entire course of the reaction procedure. This is advantageously obtained by means of a continuous runoff with constant material-current-densities of the solid and/or liquid and/or the gaseous reaction participants as well as by means of exact maintenance of the reaction temperatures within permissible limits of tolerance, as well as through maintenance of the desired chemical-thermodynamic conditions.

Figure 4:
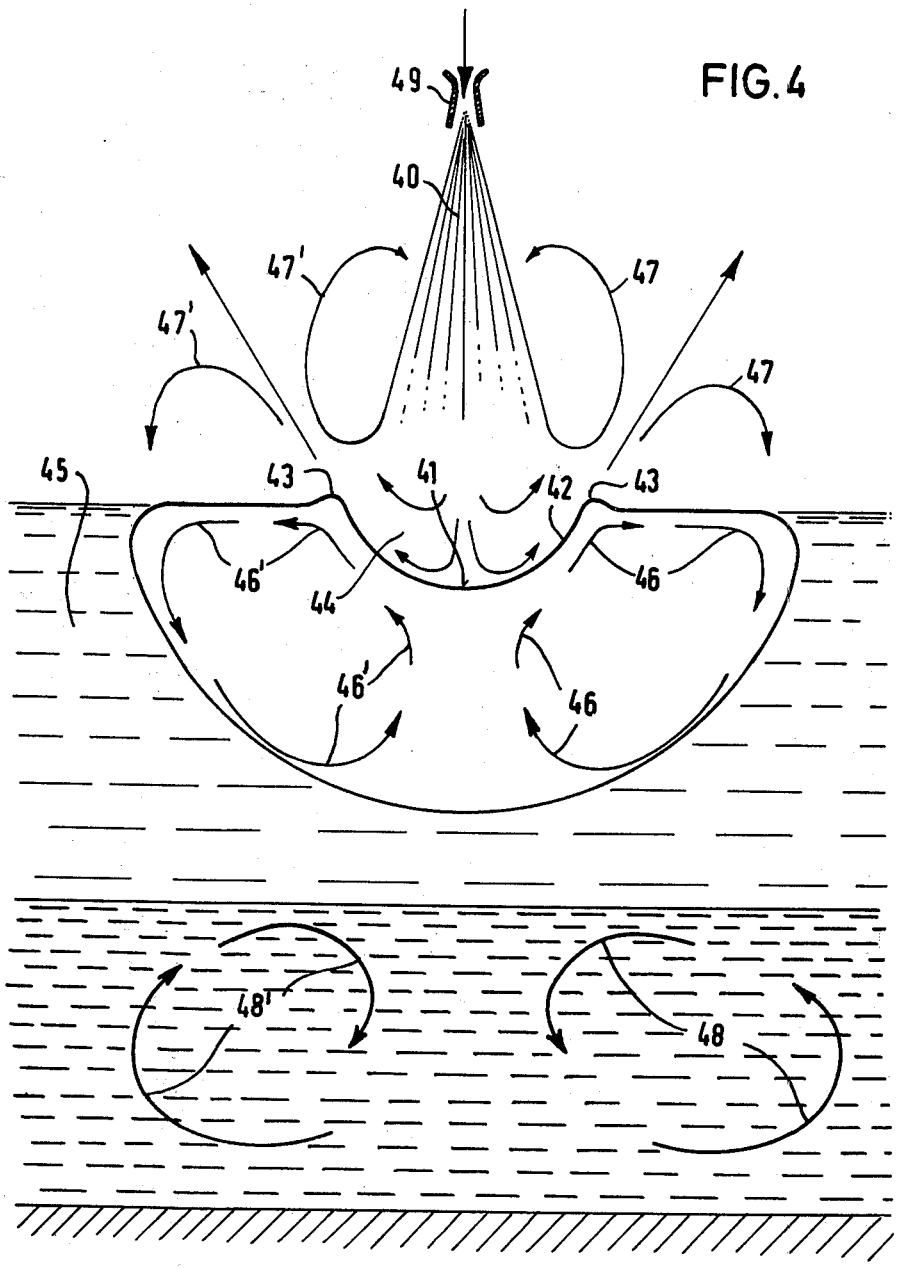
FIG. 4 is a diagrammatic view of a reaction system illustrating the action of the blower jet.

For example, according to the present invention, we make use of fresh, unused gas for delivery to the phase boundary layer. Substantially improved results are obtained by using a blower technique with a high speed jet for the reduction reaction on the molten components in the reduction zone. With a blower technique utilizing a high speed jet, the jet impinges on the surface of the smelt at a velocity between Mach 1 and Mach 3, bringing about an indentation or recess in the surface, as shown diagrammatically in FIG. 4. As also shown in this figure, an impinging jet 40 at the stagnation point 41 changes its direction and flows along the deformed surface 42 to the rim 43 of the blower impression 44. Through the friction of the jet 40 on the smelt 45, a rotational movement of the smelt 45 is brought about underneath the blower impression 44. The size of this convective flow is of significant important for the material exchange and heat exchange in the liquid phase 45. The blower jet 40 and the torus type flow indicated by the arrows 46 rotating under the blower impression 44 can be considered as a reaction-kinetic system closed in itself as seen in the idealized showing of FIG. 4. This is shown by the flow directions of the smelt indicated with the arrows 46, 46' as well as arrows 47, 47' indicating the gas movement. The counter-rotation of the heavier tin-metal phase lying under the smelt is indicated by the arrows 48, 48'.

As mentioned, the constant advance of the fresh reduction gas to the border layer of the reaction surface formed by means of the blower impression 44 insures a constant material-current density of the gaseous reaction-participant at the boundary layer. The conditions are thus best suited for a reduction of the oxidic smelt 45 by means of the gas which operates at a positive constant and fixed reduction potential. The forced convection of the smelt 45 renews the phase border layer in the reaction surface constantly. The material of the molten phase is directed in the form of a force flow from the center of the smelt against the jet impression. This results in very high convection speed and accordingly there is a drop in concentration under conditions of optimal material transfer.

One of the other important controls according to the present invention is the nature of the gaseous reduction medium. All gaseous hydrocarbon materials of gaseous form can be used which are ordinarily used in smelting techniques. For reasons of economy, however, we prefer to use a mixture of propane and methane. By a mixture of a sub-stoichiometric quantity of oxygen to the reduction gas, the desired reduction potential of the gas mixture is attained. In the free jet 40 and in the blower impression 44 of the smelt 45 the methane gas then reacts with oxygen to form a gas mixture of carbon monoxide, hydrogen, carbon dioxide and water vapor.

The gas mixture flows through the nozzle 49 which is of the Laval type. The adjustment of the parameters of the gas jet is maintained so that a spattering of the smelt 45 in the blower impression 44 is directly prevented.

Figure 3:
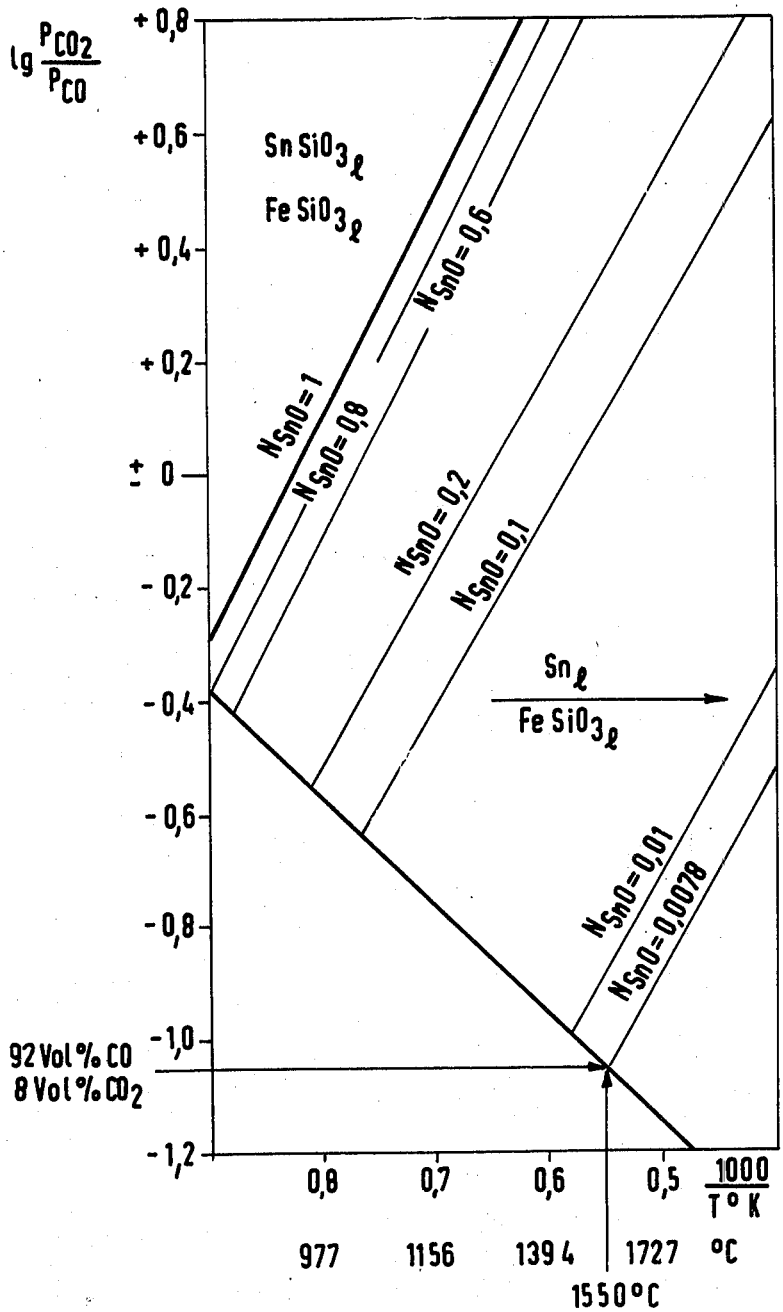
FIG. 3 is a phase diagram of $Sn/SnSiO_3/Fe/FeSiO_3$ depending on the mol fractions of SnO.

In FIG. 3 there is graphically illustrated the relationship between tin silicate and ferrous silicate and tin on the molecular fraction of tin oxide in the melt. According to this figure, a mixture containing 12% SnO, 10% CrO, 22% FeO, 34% $SiO_2$, 16% $Al_2O_3$ and 6% MgO can be reduced at an operating temperature of 1550° C. theoretically to a tin content of 1.33% Sn without a co-reduction of iron taking place. The reduction potential of the reducing gas, consisting of a mixture of 92% by volume CO and 8% by volume of $CO_2$ is maintained constant over the entire time of reduction.

In the foregoing theoretical considerations, the reduction potential of the reduction gas was defined as the ratio of partial pressure of carbon dioxide to carbon monoxide. In practice, using methane and/or propane gas as the reduction means, the reduction potential is determined through the partial pressures of the reduction gases p $CO_2$, p $H_2O$/p CO, p $H_2$. The limits of the phase areas, however, are not substantially shifted with respect to a pure $CO_2$—CO mixture. In any event, the reduction potential is increased with the presence of hydrogen in the reduction gas. For the determination of a reproducible reduction potential, however, the relation of carbon dioxide to carbon serves as an adequate starting point.

Figure 5:
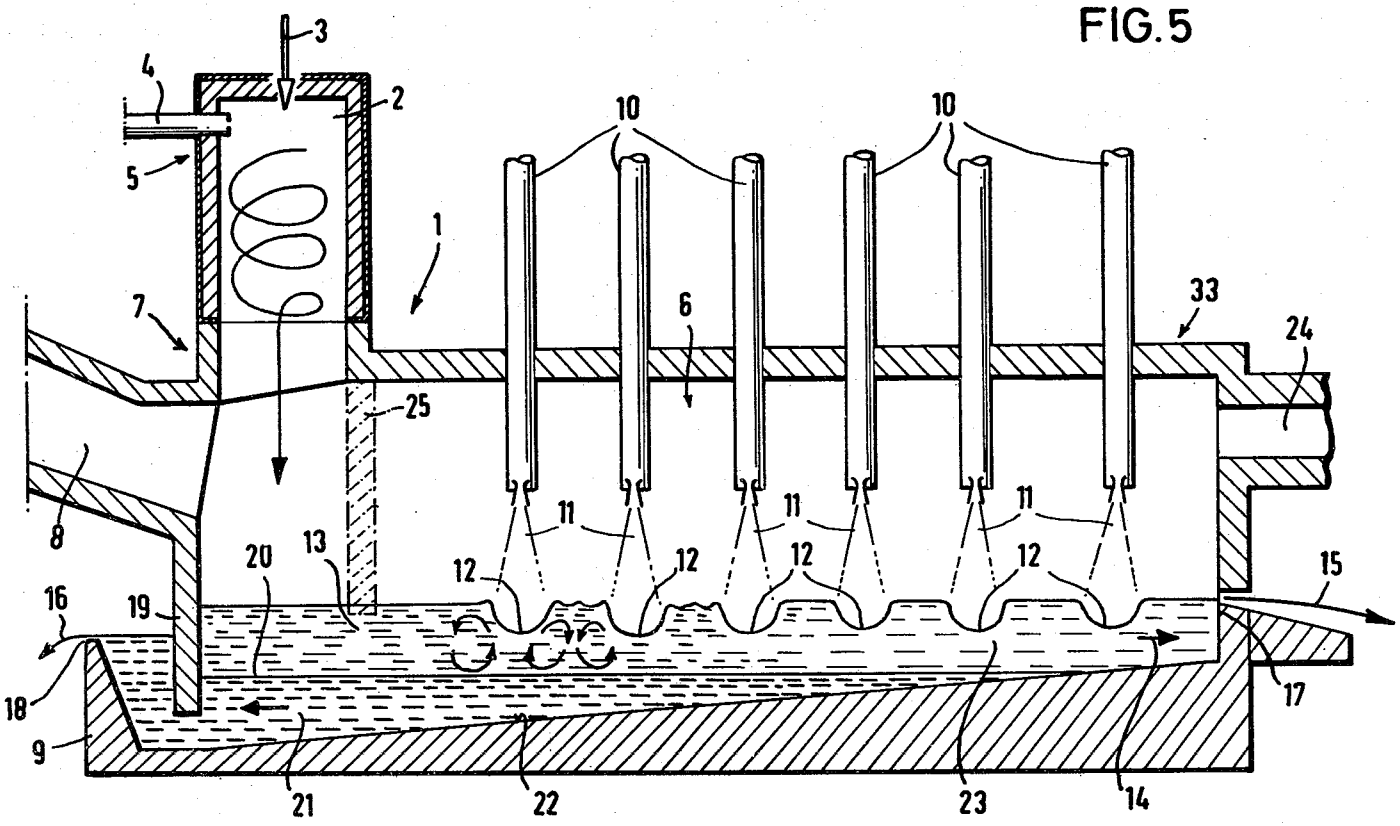
FIG. 5 is a view partly in cross section illustrating rather schematically a smelting and reduction reactor for carrying out the method of the present invention.

FIG. 5 illustrates a combined smelting and reduction reactor 1. The reactor is equipped on the material intake side with a device for the smelting of fine grained ore in suspension, such as a smelting cyclone 2.

The fine grained ore concentrate, as indicated by the arrow 3, is delivered centrally to the smelting cyclone 2 while the gas flame discharges tangentially from the burner 4 into the upper area 5 of the smelting cyclone 2. The high specific smelting output as well as the possibility of fixing the gas atmosphere in the cyclone 2 makes this assembly an ideal device for the continuous smelting of the ore concentrate.

In a slightly reducing atmosphere, for example, with a CO content of about 2 to 3% by volume, the smelting of the charge takes place continuously at temperatures of about 1500° C. The smelting mixture formed, consisting mainly of tin silicates and iron silicates flows into the lower part 6 of the reactor 1.

The initial charge into the reactor consists of tin concentrate and additives such as limestone and quartz. These additives are so proportioned in relation to the ore concentrate that under the conditions existing in the cyclone 2 the resulting smelted mixture consists of $SnO.SiO_2$, FeO. $SiO_2$, $(FeO)_2$. $SiO_2$ and other silicates. The necessary smelting heat is applied by a slightly sub-stoichiometric mixture of natural gas and preheated combustion air, which is blown in tangentially with the burner 4 in the cyclone 2.

The high relative speeds between the heating gas and the charged material and the smelted droplets, respectively, bring about an intense heat exchange. Since in the cyclone 2 neither chemical reactions nor volatilization are to be carried out, the cyclone 2 may be operated as a high output smelting assembly.

In the lower area 7 of the cyclone outlet, the liquid phase of the oxidic smelt and the gaseous phase of the exhaust gas are separated. The exhaust gas is withdrawn laterally through an exhaust channel 8 and, for example, is conveyed to a conventional exhaust gas system.

The smelt 13 enriched with tin oxide collects in the furnace tank 9 and flows under a system of water-cooled lances 10 fitted with Laval nozzles. In the free jets 11 as well as in the blower impressions or recesses 12 of the smelt 13, the methane gas reacts with the oxygen to a predetermined gas mixture of CO, $H_2$ and $H_2O$. Preferably, the reduction potential of the reducing gases introduced into the jets 11 increases in the direction of slag flow indicated by the arrow 14. As long as the reduction proceeds with a controlled gas phase, the tin content in the slowly flowing smelt 13 decreases linearly with the number of lances 10 under which it flows, in the direction of the arrow 14, and the smelt flows with substantially uniform speed through the reduction reaction chamber.

After the reduction, the reduction gas which still has a portion of combustible constituents is withdrawn through a gas channel 8 or a channel 24 and, if need be, can be burned in a waste heat boiler (FIG. 6) for the production of steam. The products derived from the reactor 6 are a slag 23 low in tin whose flow is indicated by the arrow 15, and the raw tin 21 whose flow is indicated by the arrow 16. The furnace tank 9 on the right side as shown in FIG. 5 has an overflow weir 17 for the slag and on the opposite side has an overflow weir 18 for the raw tin. In order to prevent the smelt 13 from flowing over the lower line weir 18 a retaining wall 19 is provided which is immersed to below the level 20 of the liquid raw tin 21. Through the positioning of the overflow weirs 17 and 18 there results a countercurrent flow of the lighter molten slag 23 to the heavier raw tin layer 21.

The iron-free droplets of tin formed in the blower reactor 6 accelerated by means of the movement of rotation of the smelt settle in the area of the blower impression or recess 12 relatively rapidly on the floor level or base 22 of the furnace tank 9. This floor level or base 22 has a decided inclination to the cyclone part. Thereby, the flow of the smelt 21 rich in tin proceeds countercurrent to the slag 23. Thereby, there is a reduced danger of iron dissolving in the raw tin because through the countercurrent flow, the contact time of the metallic raw tin 21 with the oxidic slags 23 is significantly reduced. The iron-free raw tin 21 is mainly only in contact with the tin rich smelt 13 which prevents the displacement of the chemical equilibrium for the reduction of iron silicate through metallic tin 21.

Figure 6:
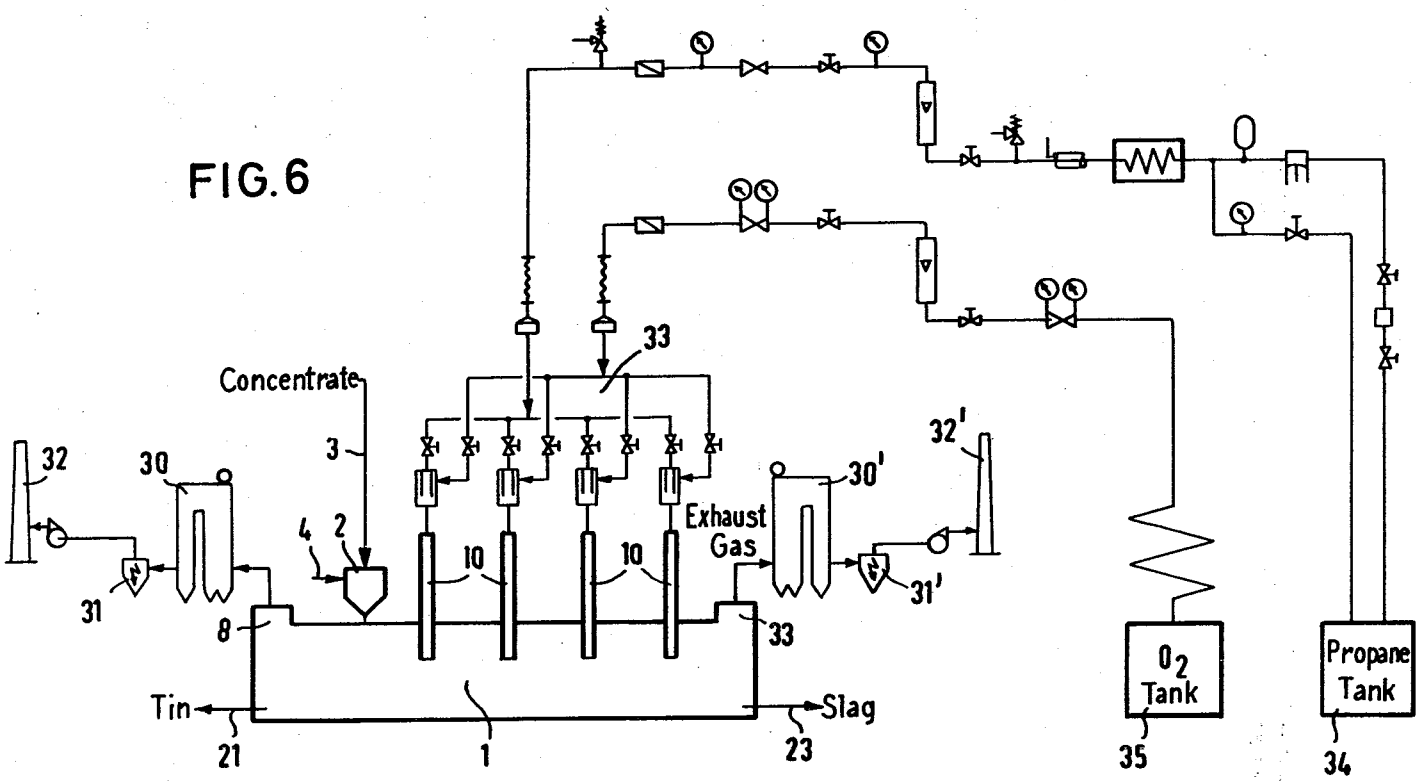
FIG. 6 is a block circuit diagram of a smelting installation according to the present invention.

FIG. 6 illustrates rather schematically a complete tin smelting plant with a cyclone and a blower reactor of the type shown in FIG. 5. The block circuit diagram illustrates the reactor 1 with the smelting cyclone 2, concentrate charger 3 and a burner 4. The exhaust gas is withdrawn through the exhaust channel 8 and is conveyed off through the waste heat boiler 30 as well as a filter 31 to a flue 32. Raw tin 21 and slag 23 produced as mentioned in connection with FIG. 5 are withdrawn in countercurrent relation. The exhaust gas may be withdrawn on the opposite side 33 of the reactor 1 and passed to devices 30', 31' for waste gas evaluation, cleansing as well as for conveying the gas to the flue 32' corresponding with devices 30, 31 and 32 on the opposite side.

The blower lances 10 are arranged to a common supply, mixing, and distribution arrangement 33 which are connected to a propane tank 34 and an oxygen tank 35 through suitable conduits not described in greater detail, together with valves as well as evaporation and conditioning devices.

The methane and oxygen use of such a metallurgical plant with a daily yield of 100 metric tons of concentrate with a tin content in the concentrate on the average of 50% to produce a slag having less than 3% tin amounts on the average to:

methane gas equals 521 $Nm^3/t$ tin for smelting
methane gas equals 381 $Nm^3/t$ tin for reduction
oxygen equals 200 $Nm^3/t$ tin for reduction.

The methane and oxygen pressure in front of the Laval nozzle amounts by calculation to 15 bar. In this example of a metallurgical output with 100 tons per day concentrate output, the cyclone has an interior diameter of 1.4 m and a smelting chamber height of 2.4 m. The blower reactor has 24 parallel disposed lances each, amounting to 48 lances in all, extending in the longitudinal direction to 12 m in length and 1 m in width.

The examples shown and described of a technical installation for the smelting and blowing reactor as well as for the corresponding smelting plant are to be regarded strictly as a preferred type of embodiment. Further modifications which suggest themselves to those skilled in the art, will, of course, fall within the present invention insofar as they come within the scope of one of the following claims.

We claim as our invention:

1. An apparatus for the recovery of tin from an iron rich tin concentrate which comprises:

a reaction chamber, smelting means for smelting said concentrate in suspension as it enters said reaction chamber, first overflow means at one end of said chamber for removing slag therefrom, a second overflow means at the other end of said chamber at a lower elevation than said first overflow means for recovering molten metal, a plurality of blower lances spaced along said reaction chamber for projecting reaction gas at the liquid surface formed therein, and discharge means in said reaction chamber located between said smelting means and the liquid surface in said chamber for discharging exhaust gases generated in said smelting means.

2. An apparatus according to claim 1 which includes:

a deflecting wall extending below the level of molten metal in said chamber in the deepest part of the chamber.

3. An apparatus according to claim 1 which has an additional means for introducing or withdrawing gases from end of said reaction chamber from said discharge means.

4. An apparatus according to claim 1 which includes:

a partition wall extending into the molten liquid in said reaction chamber and separating said smelting means and said discharge means from the remainder of said reaction chamber.

5. An apparatus according to claim 1 in which said blower lances are substantially equally spaced along said reaction chamber.

6. An apparatus according to claim 1 in which:

said blower lances include Laval type nozzles.

* * * * *